US006839993B1

(12) United States Patent
Piché

(10) Patent No.: US 6,839,993 B1
(45) Date of Patent: Jan. 11, 2005

(54) IDENTIFICATION BADGE SUPPORT

(76) Inventor: Edouard A. Piché, 2615 Parasol Dr., Troy, MI (US) 48083

( * ) Notice: Subject to any disclaimer, the term of this patent is extended or adjusted under 35 U.S.C. 154(b) by 101 days.

(21) Appl. No.: 10/245,523

(22) Filed: Sep. 17, 2002

Related U.S. Application Data

(60) Provisional application No. 60/386,532, filed on Jun. 6, 2002.

(51) Int. Cl.[7] ..... A44C 3/00

(52) U.S. Cl. ..... 40/1.5; 24/3.1; 24/3.5; 24/3.11

(58) Field of Search ..... 40/1.5, 1.6; 24/3.1, 24/3.5, 3.11, 3.12

(56) References Cited

U.S. PATENT DOCUMENTS

| | | | | | |
|---|---|---|---|---|---|
| 1,466,993 | A | * | 9/1923 | Creech | 24/3.5 |
| 3,196,461 | A | * | 7/1965 | Erhardt | 24/3.5 |
| 3,295,235 | A | * | 1/1967 | Tauber | 40/1.5 |
| 3,371,829 | A | * | 3/1968 | Phillips | 40/1.5 |
| 3,797,717 | A | * | 3/1974 | Collins | 24/3.5 |
| 3,931,688 | A | * | 1/1976 | Owens | 40/1.5 |
| 4,020,575 | A | | 5/1977 | Kruger et al. | 40/1.5 |
| 4,026,030 | A | * | 5/1977 | Kuever et al. | 33/565 |
| 4,098,014 | A | | 7/1978 | Lauer et al. | 40/1.5 |
| 4,228,569 | A | | 10/1980 | Snyder | 24/252 |
| 4,259,797 | A | * | 4/1981 | Belser | 40/1.5 |
| 4,290,215 | A | * | 9/1981 | Kise | 40/1.5 |
| 4,305,215 | A | | 12/1981 | Smith | 40/1.5 |
| 4,388,770 | A | | 6/1983 | Manor | 40/1.6 |
| D271,985 | S | | 12/1983 | Belser | D20/27 |
| D271,986 | S | | 12/1983 | Belser | D20/27 |
| D274,099 | S | | 6/1984 | Belser | D20/27 |
| D275,578 | S | | 9/1984 | Manor | D20/27 |
| 4,509,277 | A | * | 4/1985 | Bolton | 40/1.5 |
| 4,656,696 | A | | 4/1987 | De Montalembert | 24/3 R |
| 4,736,526 | A | * | 4/1988 | Hsia | 33/565 |
| 4,795,069 | A | | 1/1989 | Ferrill | 224/202 |
| 4,869,004 | A | | 9/1989 | Maloney | 40/1.5 |
| 4,961,275 | A | | 10/1990 | Klein | 40/1.5 |
| 5,313,721 | A | | 5/1994 | Filden | 40/1.6 |
| 5,640,742 | A | | 6/1997 | White et al. | 24/3.12 |
| 5,791,076 | A | | 8/1998 | Gailliard | 40/1.5 |
| D415,206 | S | | 10/1999 | Gaines | D20/27 |
| 6,035,564 | A | | 3/2000 | Cosmo et al. | 40/1.6 |
| 6,085,393 | A | | 7/2000 | Tsui et al. | 24/3.12 |
| 6,226,905 | B1 | | 5/2001 | Osuna | |
| 6,510,629 | B1 | * | 1/2003 | Smidt et al. | 40/1.5 |

* cited by examiner

*Primary Examiner*—Gary Hoge
(74) *Attorney, Agent, or Firm*—Young & Basile, P.C.; Darlene P. Condra

(57) ABSTRACT

An identification badge support is provided for placement in a breast pocket. The support is a planer member sized to fit within a pocket and having a tapered bottom peripheral edge to conform to the bottom edge of the pocket and a centrally located aperture adjacent the top peripheral edge for receiving a clasp connected to the identification badge. The planar member may include a pocket on one planar side and a cam at the bottom peripheral edge to add length for use in a deep pocket. Mechanical features may be formed on the planar member for use in measuring or drawing geometric figures and objects.

20 Claims, 2 Drawing Sheets

IDENTIFICATION BADGE SUPPORT

This applications claims priority of Provisional Application Ser. No. 60/386,532 filed on Jun. 6, 2002.

FIELD OF THE INVENTION

The present invention provides an identification badge support in the form of a pocket insert.

BACKGROUND OF THE INVENTION

Many companies and government agencies are requiring identification badges to be worn by their personnel so that pertinent information on the badge, such as the name and photograph of the wearer, is visible at all times. The identification badges themselves are generally provided with a clip or clasp capable of being removably attached to a pocket, lapel, or other part of a garment of the user.

One disadvantage of clasping the identification badge to a portion of the garment is the wear and tear to that garment and the possible damage to delicate fabrics of certain garments. Therefore, it is desirable to provide an identification badge holder which allows for continuous display of the identification badge on a person which does not damage the fabric of the garment on the person and yet is easily retrievable when required.

SUMMARY OF THE INVENTION

The identification badge support of the present invention addresses the aforementioned concerns by providing a support with more positive retention than would be provided by clipping the badge directly to a delicate or slippery fabric, thus preventing loss of the badge. In addition, the badge support orients the name and photograph of the wearer in a positive manner.

The identification badge support is provided for holding a badge connected to a clasp or clip and then placed in a pocket, such as a breast pocket, of a garment. The identification badge support includes a planar member having an upper peripheral edge, a bottom peripheral edge, and parallel side peripheral edges. The planar member has a through aperture adjacent the upper peripheral edge for receiving a portion of the clip.

In another aspect of the invention, the bottom peripheral edge of the planar member has a tapered configuration for aligning the support in the pocket so that the bottom tapered edge of the badge support rests against the bottom tapered edge of the pocket.

In yet another aspect of the invention, the upper peripheral edge may include a raised section having a pinhole therethrough for receiving a pin therein. The pin may include an achievement award, a flag pin, or other suitable decorative pin. The raised section allows the pin to be viewed above the pocket.

Another aspect of the invention may include a metric or English scale thereon. Other scales may include means for measuring the length or pitch of a screw or bolt and its threads. Other features that may aid mechanics, engineers, or the like could include a compass and a plurality of apertures with different diameters through the planar member for checking the dimensions of a screw or bolt.

In addition, as another aspect of the invention, the identification badge support may include a cam connected at the bottom peripheral edge of the planar member and is rotatably connected to the planar member by an attachment mechanism which allows the cam to be swivelled and lowered below the bottom peripheral edge in order to add length to the identification badge support for use in deep pockets. Further, the identification badge support may include demarcations imprinted or formed on the planar member at predetermined locations for providing guides for cutting the identification badge support to fit within various sized pockets.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
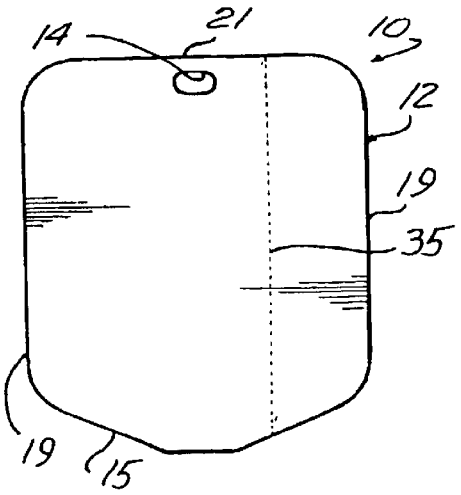
FIG. 1 is a front elevational view of the identification badge support according to the present invention.
Figure 6:
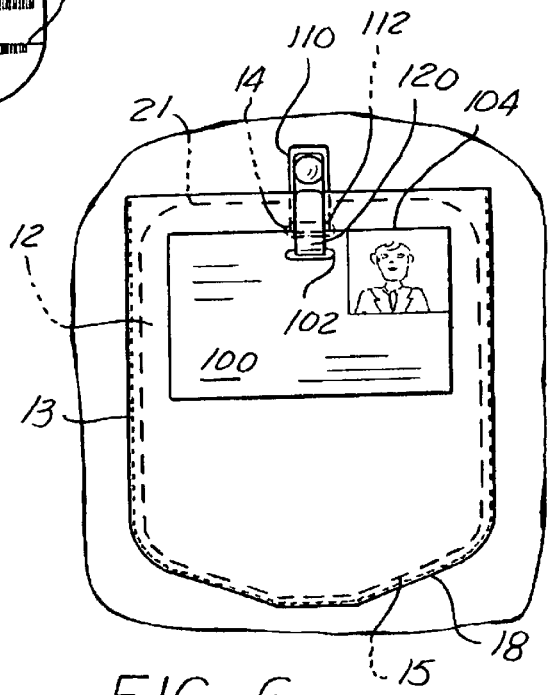
FIG. 6 is a front elevational view of the identification badge support in a pocket shown in phantom and connected to an identification badge.
Figure 7:
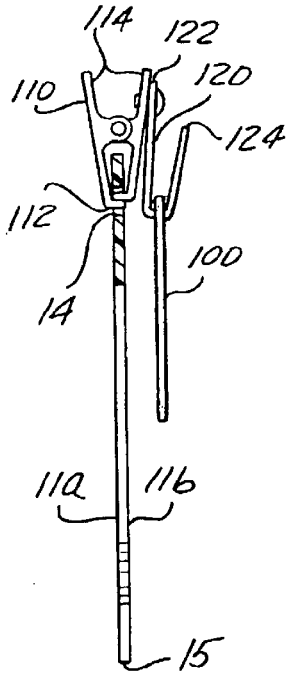
FIG. 7 is a side view of the identification badge support connected to the identification badge.

FIG. 1 shows a first embodiment of an identification badge support of the present invention. The identification badge support encompasses a planar pocket member 10 having two planar surfaces 11*a*, 11*b* and, preferably having an upper peripheral edge 21, a bottom peripheral edge 15, and a pair of parallel side peripheral edges 19. The planar pocket member 10 is configured for connection with an identification badge 100 and its associated clip 110 which is connected together via a strap or hook 120, as shown in FIGS. 6 and 7. The planar pocket member 10 is configured for essentially full insertion into a pocket 13 so that the badge support is not visible to others. The identification badge support of the present invention is especially advantageous for an identification badge having an aperture 102 near its top edge 104 for receiving the strap or hook 120 of the clip 110. The first end 122 of the strap or hook 120 is rotatably connected to one of the wings 114 of the clip 110. The second end 124 of the strap or hook 120 may be free as shown in the FIGS. 6 and 7 if the strap or hook 120 is made of stiff material. If the strap or hook 120 is made of a more flexible material, then the second end 124 may include a snap (not shown) for releasibly connecting the second end 124 to a compatible snap (not shown) at the first end 122. The pocket member or insert 10 is made of a flexible or semi-rigid flat sheet of plastic 12 configured to be essentially the same size or slightly smaller, and the same shape of a shirt or suit jacket pocket 13 so that the pocket insert 10 lays flat within the pocket 13. The pocket insert 10 has a slot 14 to receive the clip 110 from the identification badge 100. The slot 14 is centrally located adjacent the upper peripheral edge 21 of the pocket insert 10 so that the jaw ends 112 of the clip 110 pinch together through the slot 14 allowing the identification badge 100 to hang outside of the pocket 13. The slot 14 allows the jaw ends 112 to meet and grip together rather than the jaw ends 112 gripping the plastic material of the pocket insert 10 for better retention. The bottom peripheral edge 15 of the pocket insert 10 is preferably tapered 15 to conform with the inside bottom configuration 18 of most breast shirt or suit jacket pockets 13 so that the wearer properly orientates the pocket insert 10 within his pocket 13. This pocket insert 10 will allow the badge 100 to be easily detached (e.g., to pass the badge 100 through an electronic reader, to present to a security guard, etc.), while providing more positive retention than clipping to a piece of clothing. When the pocket insert 10 is installed into a pocket, the insert 10 is hidden from view, unlike a traditional "pocket protector." Although the pocket insert 10 is hidden from view, the identification badge 100 is positively retained and the photographic identification badge 100 to be displayed is in a consistent direction for ease of identification. This pocket insert 10 may be easily transferred from a suit coat pocket to a shirt pocket 13, as required. Further, due to the thin construction of the pocket insert 10, additional items (e.g. pen, notebook, etc.) may still be inserted into the pocket 13 without obstruction.

Figure 2:
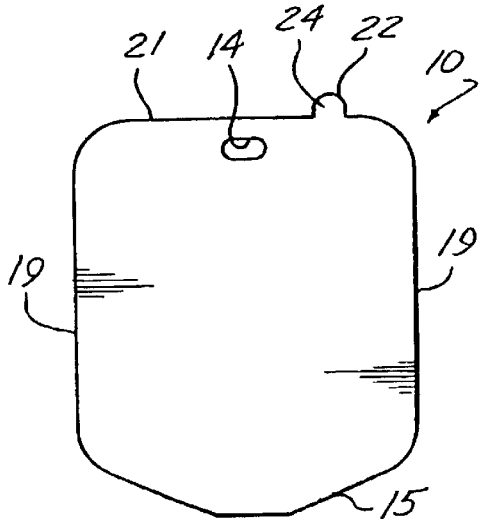
FIG. 2 is a front elevational view of a second embodiment of the identification badge support.

FIG. 2 shows a pocket insert 10 having a pin attachment feature which includes a raised section 22 formed along the upper peripheral edge 21 of the plastic sheet 12 to allow a pin to be affixed to the pocket insert 10 rather than to an article of clothing. When the pocket insert 10 is positioned within a pocket 13, the raised section 22 is exposed above the pocket 13 to allow the pin to be in view. The raised section 22 may have a pin-size center through hole 24 for receiving a pin. The pin-size center through hole 24 allows the pin (e.g., service award, American flag, etc.) to be displayed on a daily basis without the wearer needing to transfer it from one article of clothing to the next. The pin hole 24 also prevents damage and/or pin holes in a garment. Should the wearer choose not to use the raised section 22 as a pin attachment, then the raised section 22 can easily be cut off using a pair of scissors.

Figure 3A:
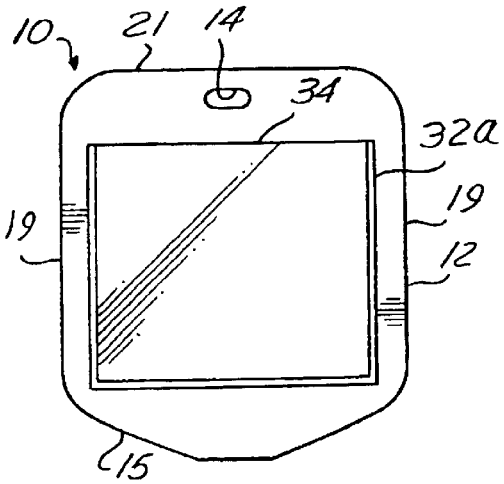
FIG. 3*a* is a front elevational view of a third embodiment of the identification badge support with a window.
Figure 3B:
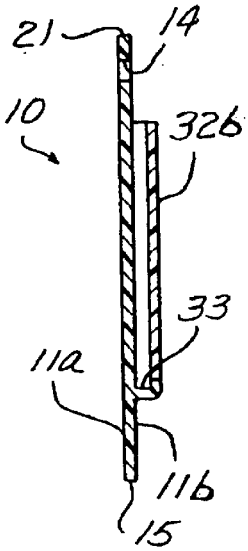
FIG. 3*b* is a sectional view of the identification badge support with a window having a depth greater than the thickness of the badge support.

FIG. 3*a* shows another variation of the pocket insert 10 which adds a transparent window 32*a*, bonded on three sides attached to one surface side 11*a* or 11*b* of the insert 10, leaving the upper end 34 open, allowing a piece of paper to be inserted into the window 32*a*. This paper insert may consist of a reference document (e.g., conversion tables, frequently used telephone numbers, etc.), corporate advertising, or any other information. A thicker window pocket 32*b* (transparent or opaque), as shown in FIG. 3*b*, can be used to store business cards, thus allowing the cards to be readily available when required. The window pocket 32*b*, shown in FIG. 3*b*, will have an interior depth 33 greater than the thickness of the planar insert 10. Although not shown in the Figures, it is also possible to provide both a flat or narrow window 32*a* on one surface side 11*a* of the pocket insert 10 and a thicker window pocket 32*b* on the other surface side 11*b* of the pocket insert 10. Any other variation of the thickness of windows 32*a*, 32*b* on each surface side 11*a*, 11*b* of the pocket insert 10 is possible.

Figure 4:
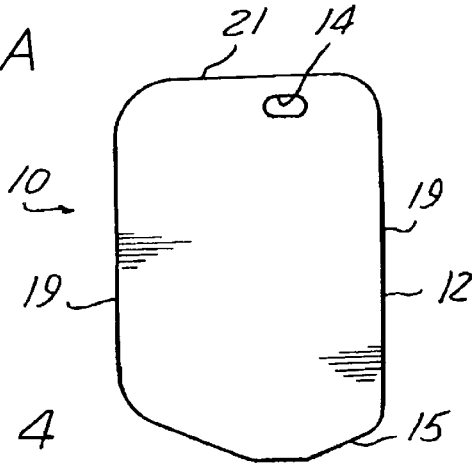
FIG. 4 is a fourth embodiment of the identification badge support.

Some shirt pockets 13 have a sewn pen/pencil segment, preventing a full-size pocket insert 10 to be used. A pocket insert 10 can be trimmed to fit this type of pocket 13, using a pair of scissors. Instructions in the packaging of the pocket insert 10 may also include cutting line demarcations 35 on the insert 10, or a specifically sized insert 10 for this purpose, can be included in the packaging of this product. A pocket insert 10 to accommodate pockets with sewn pen/pencil segments is shown in FIG. 4, while demarcations 35 to adjust a pocket insert 10 are shown in FIG. 1.

Figure 5:
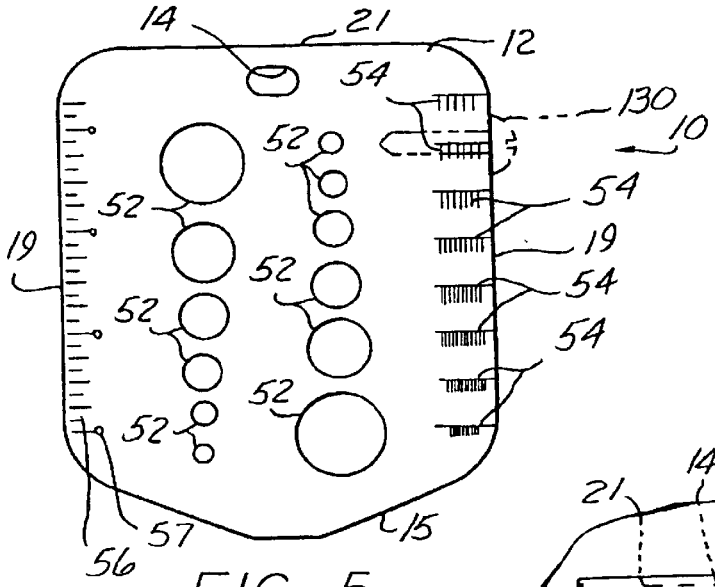
FIG. 5 is a fifth embodiment of the identification badge support.

As shown in FIG. 5, the utility of the pocket insert 10 can be further enhanced by adding a series of holes 52 for use to measure the dimensions of screws or bolts 130, and a series of predetermined precision set lines 54 added to one of the side edges 19 can be used as a reference for the pitch of a screw 130 or its length. The pocket insert 10 may also include apertures 57 for drawing arcs or circles and a standard rule 56 preferably located along another side edge 19. These features can be provided in either English or metric or both and are useful for machinists, mechanics, engineers, or others. The pocket insert 10 may include any one or more of the aforementioned enhancements.

Figure 8:
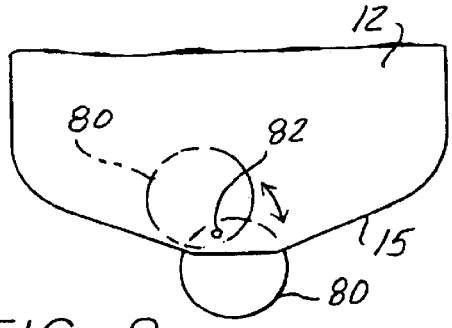
FIG. 8 is a front elevational view of the bottom portion of the identification badge support showing a cam.

FIG. 8 shows a cam 80 added to the bottom portion of the pocket insert 10 adjacent to the bottom peripheral edge 15 to selectively provide added length to the pocket insert 10 for use with an exceptionally deep pocket 13. The cam 80 is selectively rotatable around an attachment mechanism 82, such as a rivet that is eccentrically attached to the cam 80 and to the pocket insert 10 adjacent to the tapered edge 15. The cam 80 may be made of the same material as the plastic sheet 12 or of a more rigid plastic or other material. The attachment mechanism 82 securely holds the cam 80 in any position. However, the attachment mechanism 82 allows the cam 80 to be pivoted manually. Therefore, the cam 80 can be manually pivoted to provide numerous extension lengths to the pocket insert 10. If no added length is required, the cam 80 can be pivoted to be fully within the periphery of the pocket insert 10 as shown in phantom in FIG. 8. Although a circular cam 80 is shown and preferred, the cam 80 may have other configurations.

The identification badge support 10 of the present invention provides a convenient means for wearing and displaying an identification badge 100. The badge support 10 lays flat in the wearer's pocket 13 and is virtually invisible to others. The badge support 10 allows easy removal of the identification badge 100 for presentation to others or to electronic devices. The badge support 10 also avoids clipping of the identification badge 100 to personal clothing and therefore helps to prevent stretching or tearing of material in the pocket area. Further, the additional features that may be added to the badge support 10 provides conveniences for persons in a wide range of occupations.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An identification badge support for a breast pocket for holding a badge connected to a clasp, the support comprising a planar member having an upper peripheral edge, a bottom peripheral edge, and a pair of parallel side peripheral edges, said planar member having a through aperture adjacent the upper peripheral edge for receiving a portion of the clasp, wherein the upper peripheral edge includes a raised section with a pin hole therethrough for receiving a pin therein.

2. The identification badge support of claim 1 wherein the bottom peripheral edge has a tapered configuration for aligning the support in the breast pocket.

3. The identification badge support of claim 1, wherein the planar member has first planar surface and a second planar surface and at least one planar surface has a pocket formed thereon.

4. The identification badge support of claim 3, wherein the pocket is made of a transparent material.

5. The identification badge support of claim 1, wherein the planar member includes measurement means and means for facilitating the drawing of geometric forms.

6. The identification badge support of claim 1 further comprising a circular cam rotatably and eccentrically connected to the planar member for adding length to the planar member.

7. The identification badge support of claim 6 wherein the cam is adjacent to the bottom peripheral edge.

8. An identification badge support for a breast pocket for holding a badge connected to a clasp, the support comprising a planar member having an upper peripheral edge, a bottom peripheral edge, and a pair of parallel side peripheral edges, said planar member having a through aperture adjacent the upper peripheral edge for receiving a portion of the clasp, wherein the planar member has means for being received in a pocket having a sewn pen/pencil segment and wherein the through aperture adjacent to the upper peripheral edge is positioned closer to one of the side peripheral edges for maintaining the identification badge centered over the breast pocket.

9. The identification badge support of claim 8, wherein the bottom peripheral edge has a tapered configuration for aligning the support along a lower tapered edge in the breast pocket.

10. The identification badge support of claim 9 further comprising a circular cam eccentrically riveted to the planar member adjacent to the tapered edge for selectively adding length to the planar member.

11. The identification badge support of claim 8, wherein the planar member has a first planar surface and a second planar surface and at least one planar surface has a pocket formed thereon.

12. The identification badge support of claim 8, wherein the planar member includes measurement means and means for facilitating the drawing of geometrical forms.

13. An identification badge support for a breast pocket for holding a badge connected to a clasp, the support comprising a planar member having an upper peripheral edge, a bottom peripheral edge, and a pair of parallel side peripheral edges, said planar member having a through aperture adjacent the upper peripheral edge for receiving a portion of the clasp and a circular cam rotatably and eccentrically connected to the planar member for adding length to the planar member, wherein the cam is adjacent to the bottom peripheral edge.

14. An improved identification badge support of the type having a clip with a pair of wings at one end, pinching jaws at the other end, and a separate badge securing means, a first end of the badge securing means connected to one of the wings at a location spaced from the jaws, wherein the improvement comprises: a planar member having an upper peripheral edge, a bottom peripheral edge, and a pair of parallel side peripheral edges, said planar member having a through slot sized for selectively receiving the pinching jaws therein, said slot positioned adjacent the upper peripheral edge of the planar member.

15. The improved identification badge support of claim 14, wherein the bottom peripheral edge has a tapered configuration for aligning the support in the breast pocket.

16. The improved identification badge support of claim 15 wherein the planar member is made of a semi-rigid material.

17. The improved identification badge support of claim 15, wherein the planar member includes measurement means and means for facilitating the drawing of geometric forms.

18. The improved identification badge support of claim 15, wherein the planar member has a circular cam eccentrically riveted to the planar member adjacent to the bottom peripheral edge for selectively adding length to the planar member.

19. The improved identification badge support of claim 14, wherein the planar member has a first planar surface and a second planar surface and at least one planar surface has a pocket formed thereon.

20. The improved identification badge support of claim 16, wherein the planar member has a predetermined thickness and the pocket has an interior with a thickness greater than the predetermined thickness of the planar member for storing business cards therein.

* * * * *